US010638838B2

(12) United States Patent
Stöckli et al.

(10) Patent No.: US 10,638,838 B2
(45) Date of Patent: May 5, 2020

(54) RETRACTING DEVICE FOR A DRAWER MECHANISM

(71) Applicants: USM HOLDING AG, Muri bei Bern (CH); ACCURIDE INTERNATIONAL GMBH, Diez/Lahn (DE)

(72) Inventors: Kaspar Stöckli, Kiesen (CH); Christian Satony, Urbar (DE); Thomas Dienes, Bern (CH); Alexander Schärer, Muri bei Bern (CH)

(73) Assignees: USM Holding AG, Muri Bei Bern (CH); Accuride International GMBH, Diez-Lahn (DE)

( * ) Notice: Subject to any disclaimer, the term of this patent is extended or adjusted under 35 U.S.C. 154(b) by 0 days.

(21) Appl. No.: 16/331,650

(22) PCT Filed: Sep. 18, 2017

(86) PCT No.: PCT/EP2017/073469
§ 371 (c)(1),
(2) Date: Mar. 8, 2019

(87) PCT Pub. No.: WO2018/059987
PCT Pub. Date: Apr. 5, 2018

(65) Prior Publication Data

US 2019/0239645 A1 Aug. 8, 2019

(30) Foreign Application Priority Data

Sep. 30, 2016 (EP) ..... 16191873

(51) Int. Cl.
*A47B 88/467* (2017.01)
*E05B 65/463* (2017.01)
(Continued)

(52) U.S. Cl.
CPC ..... *A47B 88/467* (2017.01); *A47B 88/473* (2017.01); *A47B 88/483* (2017.01); *E05B 65/463* (2013.01)

(58) Field of Classification Search
CPC ... A47B 88/467; A47B 88/473; A47B 88/483; A47B 88/47; A47B 2210/0018;
(Continued)

(56) References Cited

U.S. PATENT DOCUMENTS 6,296,332 B1 * 10/2001 Lammens ..... E05B 65/464 312/217
8,939,525 B1 * 1/2015 Chen ..... A47B 88/467 312/333
(Continued)

FOREIGN PATENT DOCUMENTS

DE 112008001880 T5 5/2010
DE 202009000050 U1 6/2010
(Continued)

OTHER PUBLICATIONS

Machine translation for DE102010037826, (Year: 2012).*

*Primary Examiner* — Hiwot E Tefera
(74) *Attorney, Agent, or Firm* — Gable Gotwals

(57) ABSTRACT

A retraction device for a drawer mechanism comprises a spring-loaded carriage that can be moved in the push-in/pull-out direction for temporary coupling to an inner rail of the drawer mechanism. The carriage can be clocked in a retraction position by means of a locking slide that can be moved transverse to the push-in/pull-out direction in a guide. For coupling to the inner rail the carriage has at least one pivot element, which can be pivoted about an axis oriented perpendicular to the push-in/pull-out direction and perpendicular to the direction of movement of the locking slide. The pivot element and guide are arranged in such a
(Continued)

manner that, in a locking position, the locking slide blocks a pivoting movement of the pivot element.

14 Claims, 4 Drawing Sheets

(51) Int. Cl.
*A47B 88/473* (2017.01)
*A47B 88/483* (2017.01)

(58) Field of Classification Search
CPC ..... A47B 2210/0054; A47B 88/477; A47B 2210/0091; A47B 88/463; A47B 2210/005; E05B 65/463; E05B 65/464; E05B 65/462; E05B 65/46; E05B 17/0041; E05F 5/003; E05F 1/16
See application file for complete search history.

(56) References Cited

U.S. PATENT DOCUMENTS

2005/0023941 A1* 2/2005 Chiu ..... E05B 65/464 312/221
2005/0104485 A1* 5/2005 Chiu ..... E05B 65/464 312/221
2005/0104492 A1* 5/2005 Chiu ..... A47B 88/467 312/333
2007/0040484 A1* 2/2007 Huang ..... E05B 65/464 312/221
2007/0159038 A1* 7/2007 Huang ..... E05B 65/462 312/333
2007/0182292 A1* 8/2007 Huang ..... E05B 65/464 312/221
2007/0284976 A1* 12/2007 Huang ..... E05B 65/464 312/220
2008/0061663 A1* 3/2008 Wu ..... E05B 65/463 312/333
2008/0074017 A1* 3/2008 Ruan ..... E05B 65/464 312/221
2012/0013234 A1* 1/2012 Huang ..... E05B 65/464 312/334.7
2012/0144622 A1* 6/2012 Juan ..... A47B 88/467 16/51
2013/0182978 A1* 7/2013 Huang ..... E05F 5/003 384/21
2014/0079347 A1* 3/2014 Huang ..... A47B 88/467 384/21
2016/0296015 A1* 10/2016 Zhu ..... A47B 88/49
2017/0020285 A1* 1/2017 Schallert ..... A47B 88/47
2018/0132615 A1* 5/2018 Kim ..... A47B 88/477

FOREIGN PATENT DOCUMENTS

DE 102010037826 A1 * 3/2012 ..... A47B 88/467
DE 102011000493 A1 8/2012
DE 102012109751 A1 4/2014
EP 1500763 A2 1/2005

* cited by examiner

RETRACTING DEVICE FOR A DRAWER MECHANISM

CROSS-REFERENCE TO RELATED APPLICATIONS

This application is the United States National Phase of Patent Application No. PCT/EP2017/073469 filed 18 Sep. 2017, which claims priority to European Patent Application No. 16191873.5 filed 30 Sep. 2016, each of which are incorporated herein by reference.

TECHNICAL FIELD

The invention relates to a retraction device for a drawer mechanism, having a spring-loaded slide movable in the retraction/extension direction for temporarily coupling to an inner rail of the drawer mechanism, wherein the slide is capable of being blocked in a retraction position by a blocking latch bolt that in a guide is movable transversely to the retraction/extension direction, wherein the slide for coupling to the inner rail has at least one pivot element which is pivotable about an axis that is oriented so as to be perpendicular to the retraction/extension direction and perpendicular to the movement direction of the blocking latch bolt.

PRIOR ART

Drawer mechanisms which comprise a fixed rail element for attaching to a furniture cabinet and at least one movable rail element mounted on said fixed rail element are known. The innermost movable rail element, the inner rail, is fastened to an extendable part of the furniture. Depending on the length of the drawer mechanism and on the extension length, further movable rail elements can be disposed between the fixed rail element and the inner rail, said further movable rail elements interacting in a telescopic manner. The rail elements are mounted on one another by way of ball or roller guides, for example.

Drawer mechanisms are in general suitable for mounting extendable furniture parts; for the sake of simplicity the term "drawer" will in each case be used hereunder. However, the retraction devices described are in principle suitable for various extendable furniture parts. One mechanism is in each case typically disposed on one drawer.

Retraction devices for drawer mechanisms automatically guide the drawer to the terminal position thereof when said drawer is inserted. On account thereof, the ease of operation of the drawer is improved and the generation of noise when closing can be minimized. Known retraction devices acquire the inner rail and guide the latter along a part-distance of the closing movement, from a standby position of the retraction device to the closed state.

For example, a retraction device which comprises a movable slide on which a latch for interacting with the inner rail is rotatably disposed is known from DE 11 2008 001 880 T5 (Accuride International Inc.).

In the case of items of furniture having a plurality of drawers that are disposed below one another, a simultaneous extraction of a plurality of drawers is often to be prevented, specifically so as to avoid any risk of tilting by way of a plurality of heavy extracted drawers as well as a risk of injury by way of body parts of the users being jammed. In this context it is known for blocking latch bolts to be provided, said blocking latch bolts being coupled to the drawer mechanisms and preventing an extraction of a further drawer when one drawer has already been fully or partially extracted.

DE 10 2012 109 751 A1 (Paul Hettich GmbH & Co. KG) describes a drawer mechanism having a self-retracting or ejecting device which has a repositionably mounted entrainment element by way of which the retraction or ejection device, respectively, can be activated. To this end, an activator which is disposed on a closure stopper that is plug-fitted onto the front end of the inner rail interacts with the entrainment element. The entrainment element moreover has a pin for engaging in a locking strip for locking and unlocking a plurality of drawers that are disposed on top of one another.

This mechanism has a complex construction having many parts. In the case of predefined mechanical requirements set for the mechanism, correspondingly high production costs result. The construction is not expedient for an embodiment without an ejection function.

SUMMARY OF THE INVENTION

It is an object of the invention to achieve a retraction device which is associated to the technical field mentioned at the outset and which is constructed in a simple manner and is mechanically robust.

The achievement of the object is defined by the features of claim 1. According to the invention, the pivot element and the guide are disposed in such a manner that the blocking latch bolt in a blocking position blocks a pivoting movement of the pivot element.

Besides the elements that are present anyway, specifically the blocking latch bolt and the pivot element, no further components are required. A simple construction results on account thereof. Low costs and a high mechanical stability result therefrom.

The retraction device is in particular attached to the fixed rail element. The spring means coupled to the slide can be a single coil spring that runs in a linear manner, a coil spring that is deflected by 180° along an arc, or a plurality of coil springs disposed in parallel. Other spring means, for example helical springs or torsion springs, are also conceivable.

The interaction between the inner rail and the pivot element is in particular performed by way of elements such as protrusions, pins, or clearances that are disposed in the region of the free end of the inner rail, wherein the geometry of the pivot element is adapted to the geometry of said elements. The elements on the inner rail can be configured so as to be integral to said inner rail or be fixedly or releasably fastened to said inner rail.

As has been mentioned, the pivot element is pivotable about an axis that is oriented so as to be perpendicular to the retraction/extension direction and perpendicular to the movement direction of the blocking latch bolt, that is to say that said pivot axis is also perpendicular to a main plane of the rails of the drawer mechanism.

The blocking latch bolt in a manner known per se is in particular fastened to a blocking bar. A further blocking latch bolt which interacts with the neighboring drawer is fastened to the other end of the blocking bar. When one drawer is opened the blocking latch bolts that interact with the retraction device of said drawer are pressed out of the retraction device and thus into the retraction devices of the neighboring drawers such that the extraction of the latter is prevented.

The pivot element preferably has a holding portion that in an extension movement interacts with the inner rail. The pivot element herein is mounted on the slide in such a manner that the holding portion in a release position in relation to a holding position is pivoted in the direction of a longitudinal central axis of the slide. The holding portion during the retraction procedure and along a part-distance in the subsequent extension of the drawer causes a form-fitting coupling between the inner rail and the slide in the retraction/extension direction. The spring force that acts on the slide for the automatic retraction can thus be transmitted to the inner rail, and the opening force exerted on the drawer in the renewed opening is transmitted to the slide such that the spring means can be tensioned again. The part-distance ends where the pivot element has reached the release position. The slide in this position in a manner known per se is locked to a stationary element by means of the pivot element. Said slide can only move in the retraction direction again once the pivot element in the insertion of the drawer is in turn contacted by the inner rail.

The mentioned mounting of the pivot element on the slide enables a simple interaction of the blocking latch bolt with the pivot element in that the blocking latch bolt can in particular interact with the region of the pivot element which is located on the opposite side of the holding portion in relation to the pivot axis. The individual lever portions of the pivot element on both sides of the pivot axis can thus be configured so as to be relatively short, this benefiting the mechanical stability.

Alternatively, the pivot element can be mounted on the slide in such a manner that the holding portion in the release position is pivoted outward, that is to say away from the longitudinal central axis of the slide. The interaction between the pivot element and the blocking latch bolt in this case takes place either on the lever side of the holding portion or by way of a corresponding mechanism for deflecting a movement of the blocking latch bolt.

The pivot element advantageously has an eccentrically disposed (that is to say spaced apart therefrom) cam pin which for controlling the pivoting movement in a movement of the slide in the retraction/extension direction interacts with a stationary curve. "Stationary" in this context means that the curve is not conjointly moved with the slide. The interaction between the cam pin and the curve ensures in particular that the pivot element reaches the release position in the correct position. Said interaction can furthermore also serve for the afore-mentioned locking on the stationary element. The curve, proceeding from the retracted position, has in particular an axial portion in which the pivot element without rotation is conjointly moved with the slide in the extension direction, an oblique portion in which the rotation of the pivot element to a release position is performed, as well as a locking portion which runs in particular perpendicularly to the retraction/extension direction and forms a portion on which the cam pin is supported for locking the slide.

Controlling the movement of the pivot element can in principle also be performed in another manner, for example by way of a (stationary) rack and a pinion that is coupled to the pivot element.

The stationary curve in a part-portion preferably has an elastic delimitation wall such that the inner rail in a retracted position of the retraction device is capable, by overcoming an insertion force, of being coupled to the slide in that the holding portion of the pivot element is temporarily pivoted, wherein the cam pin temporarily deforms the elastic delimitation wall. This function is required when the retraction device for any reason is located in the retracted position, but the drawer having the inner rail is initially open. This may be the case in the context of the assembly or after an erroneous manipulation. On account of the procedure mentioned, it is possible for the inner rail to again be coupled to the retraction device in the envisaged manner by simply inserting the drawer.

The retraction device preferably comprises a guide receptacle in which the slide is mounted so as to be movable in a linear manner in the retraction/extension direction. The guide receptacle can be an integral part of the fixed rail element. However, said guide receptacle is advantageously an additional component which is capable of being fastened to the fixed rail element, for example by way of a latching connection. The fixed rail element has in particular a U-shaped cross section, and the guide receptacle is received within the space defined between the two legs at the base of the fixed rail element.

The stationary curve is preferably configured on the guide receptacle. A simple and mechanically stable construction results on account thereof.

The pivot element advantageously has an activation portion that in a retraction movement interacts with the inner rail. Said activation portion when inserting the drawer is contacted by the inner rail (or contact elements disposed on said inner rail, respectively), such that the slide is released from the axial locking thereof. The holding portion of the pivot element simultaneously engages with the inner rail (or contact elements disposed on said inner rail, respectively), such that the inner rail (conjointly with the drawer) by virtue of the spring action conjointly with the slide is entrained in the retraction direction and up to the retracted position. The activation portion and the holding portion thus form a receptacle, the element of the inner rail that interacts with the pivot element being received therebetween during the retraction movement and along the mentioned part-distance when extending.

Alternatively, no activation portion of this type is present. In this case, the release is caused by way of direct contact between the inner rail and the slide, for example.

The pivot element preferably has a blocking portion which in the blocking position interacts with the blocking latch bolt. This blocking portion is dimensioned in such a manner that a secure and mechanically reliable interaction with the blocking latch bolt results.

The blocking portion advantageously comprises a lug which in the blocking position engages behind a free end of the blocking latch bolt. The lug avoids a pivoting movement of the pivot element even when the blocking latch bolt is slightly displaced outward, for example by virtue of material tolerances in the blocking mechanism such as can arise, for example, by virtue of a thermal contraction of the blocking bars that connect the blocking latch bolts. Pivoting during a first movement portion, proceeding from the closed position, is thus reliably prevented even in the case of a not completely inserted blocking latch bolt. This is in particular important when the pivot element in the closed position, by virtue of an elastic delimitation wall of the curve (or for other reasons), is pivotable so as to enable an introduction of an inner rail that initially is not coupled. If the pivot movement is not prevented, it would otherwise be possible in this case for the inner rail in the case of a blocked retraction device, again by overcoming a specific force, to be released from the slide and for the drawer thus nevertheless be opened.

The slide advantageously has a blocking face which in the blocking position interacts with the blocking latch bolt. The slide, by inserting the blocking latch bolt, is thus prevented from moving in the opening direction.

The blocking portion and the blocking face in the retracted state of the slide preferably conjointly form a receptacle for the blocking latch bolt, said receptacle tapering in the direction of a longitudinal central axis of the slide. The receptacle is in particular configured so as to be substantially triangular or trapezoidal. This enables a conversion of the extension force that acts on the slide (and the pivot element) to an ejection force that is directed transversely to the retraction/extension direction and acts on the blocking latch bolt.

The holding portion of the pivot element is advantageously disposed on a first side of the slide that faces the inner rail, and the blocking portion of the pivot element is disposed on a second side of the slide that is opposite the first side. The slide comprises in particular a base plate on the which the further components of said slide are disposed and optionally mounted. The base plate in the region of the pivot element comprises a breakout, portions of the pivot element protruding through the latter. Besides the blocking portion, also the cam pin is thus in particular located on the second side that faces the stationary curve.

Alternatively, both the holding portion as well as the blocking portion are on the same side, in particular on the side of the slide that faces the inner rail.

Two pivot elements are preferably disposed so as to be symmetrical to the longitudinal central axis of the slide. On account thereof, and more uniform transmission of force can be achieved, and the transmitted forces are moreover distributed to two spaced-apart contact faces. Torques, by virtue of eccentrically acting forces from the inner rail that act on the slide and thus the retraction device, substantially cancel out one another by virtue of the symmetrical arrangement.

Alternatively, only one pivot element is present. It is also possible for more than two pivot elements to be provided.

The retraction device advantageously has a damping element that is received in the slide. The damping element is in particular configured as a fluid damper. Said damping element preferably has a spring which moves the damping to an axially elongated position.

The damping element enables a relatively slow retraction movement. A hard impact upon complete closing and the noise generation associated therewith are prevented. The risk of injury on account of jammed hands of fingers is likewise minimized.

A damper rod of the damping element preferably interacts with a stationary element of the retraction device. This enables a simple construction. The stationary element can in particular be the guide receptacle for the slide.

The stationary element is advantageously disposed in the retraction direction of the slide. The damper thus interacts with the stationary element in a region, said stationary element lying opposite the interaction region with the inner rail. The respective interactions thus do not hamper one another.

In one preferred embodiment, the retraction device comprises the following:

a) a slide for temporary coupling to an inner rail of the drawer mechanism;
b) a guide receptacle in which the slide is mounted so as to be movable in a linear manner in the retraction/extension direction;
c) spring means which are disposed between the slide and the guide receptacle and which impinge the slide with a spring force in the retraction direction;
d) two pivot elements which are disposed on the slide so as to be symmetrical in relation to the longitudinal central axis of said slide and which are pivotable about an axis that is oriented so as to be perpendicular to the retraction/extension direction and perpendicular to the movement direction of the blocking latch bolt;
e) two curves that are configured on the guide receptacle for interacting with in each case one cam pin that for controlling the pivoting movement of the pivot element is eccentrically disposed on a pivot element.

The slide herein is capable of being blocked in a retraction position by a blocking latch bolt that is repositionable transversely to the retraction/extension direction, in that the blocking latch bolt in the blocking position blocks a pivoting movement of the pivot element.

Further advantageous embodiments and combinations of features of the invention are derived from the detailed description hereunder and the entirety of patent claims.

BRIEF DESCRIPTION OF THE DRAWINGS

In the drawings used for explaining the exemplary embodiment.

Identical parts in the figures are in principle provided with the same reference signs.

WAYS FOR IMPLEMENTING THE INVENTION

Figure 1:
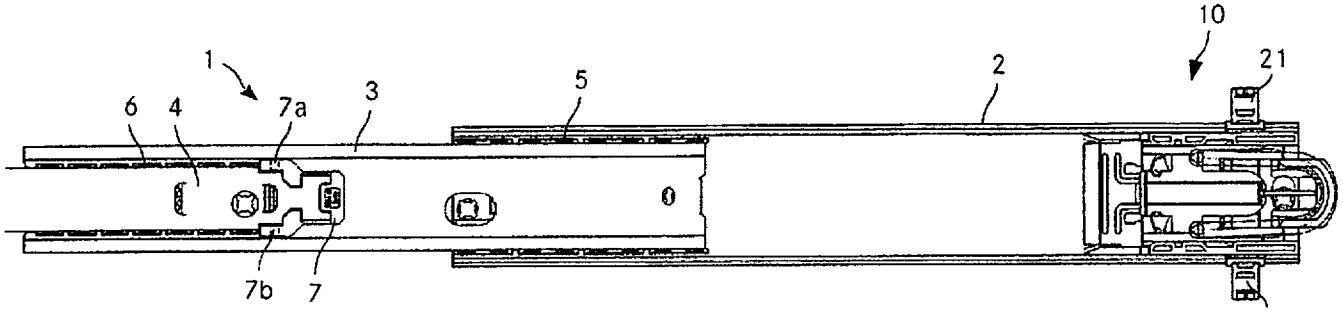
FIG. 1 shows a drawer mechanism having a retraction device according to the invention, in a partially extended position.
Figure 2:
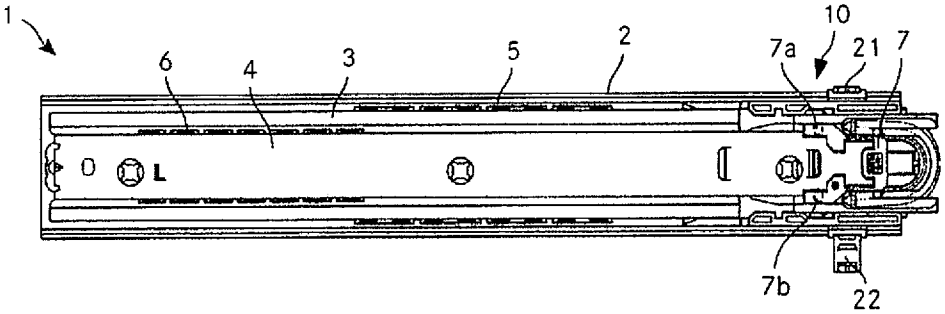
FIG. 2 shows the drawer mechanism in the retracted position.

FIG. 1 shows a drawer mechanism having a retraction device according to the invention, in a partially extended position. FIG. 2 shows the drawer mechanism in the retracted position. The drawer mechanism 1 comprises an outer rail 2, a central rail 3, and an inner rail 4, said rails being mounted so as to be telescopic on one another. To this end, roller bearings 5, 6 are disposed in an manner known per se between the outer rail 2 and the central rail 3, as well as between the central rail 3 and the inner rail 4. The three rails can thus be mutually repositioned in a linear manner by way of little resistance. All three rails are in each case formed by a substantially U-shaped profile from sheet metal. The central rail 3 herein is completely received between the legs of the outer rail 2, the inner rail 4 is in turn completely received between the legs of the central rail 3.

The retraction device 10 according to the invention is disposed on the free end of the outer rail 2.

Said retraction device 10 is described in detail in the context of the further FIGS. 3 to 7. Two blocking latch bolts 21, 22, which are mounted on the retraction device 10 so as to be displaceable in a linear manner perpendicularly to the retraction/extension direction of the drawer mechanism 1 in the main plane of the drawer mechanism 1, interact with the retraction device 10, on the one hand. A contact piece 7 that is disposed on the end of the inner rail 4 that faces the retraction device 10 interacts with the retraction device 10, on the other hand. Said contact piece is made of plastics material and by way of a latching connection is disposed on the end of the inner real 4. Said contact piece on the side thereof that faces the outer rail 2 has two holding cams 7*a*, 7*b* (cf. also FIG. 5).

As is described in detail further below, the blocking latch bolts 21, 22, in the retracted position of the retraction device 10, by way of the free ends thereof engage in the retraction device 10 and interact with the latter. The blocking latch bolts 21, 22 at the opposite end are fixedly connected to a blocking bar which at the other end is connected to a further blocking latch bolt which interacts with the retraction device of a neighboring drawer. The uppermost or lowermost drawer, respectively, interacts in each case only with one blocking latch bolt on the side that faces the next lower or next upper drawer, respectively. The blocking bars having the blocking latching bolts are vertically oriented and freely movable along a linear guide. In as far as the respective lower retraction device is located in the retracted position, the blocking latch bolt that is connected to the blocking bar, by virtue of the influence of gravity, will move into the retraction device, while the upper blocking latch bolt that is attached to the same blocking bar is moved out of the respective upper retraction device.

Figure 3:
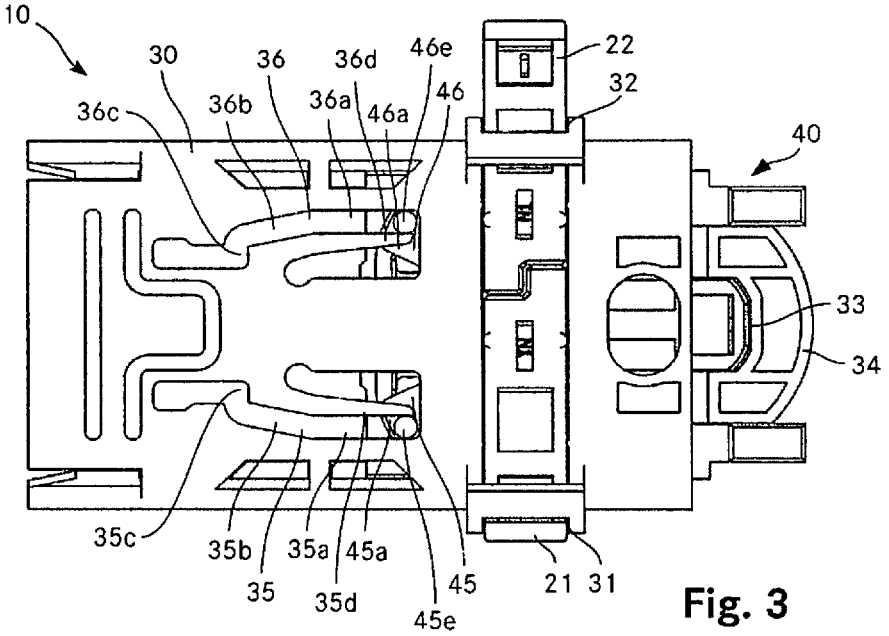
FIG. 3 shows a rear view of the retraction device according to the invention, in the retracted position.
Figure 4:
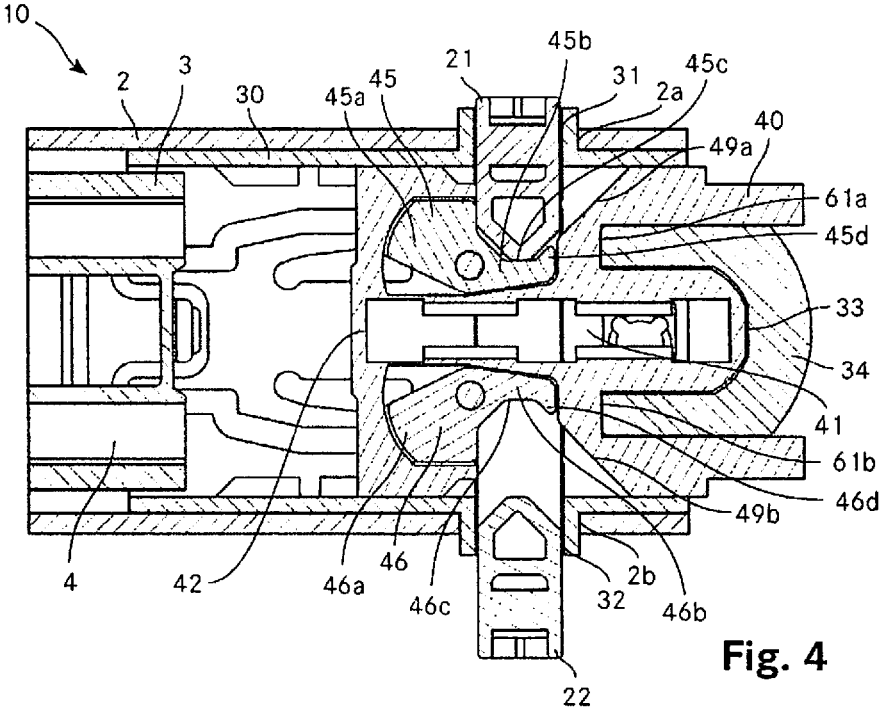
FIG. 4 shows a first cross section through the retraction device according to the invention, in the retracted position.
Figure 5:
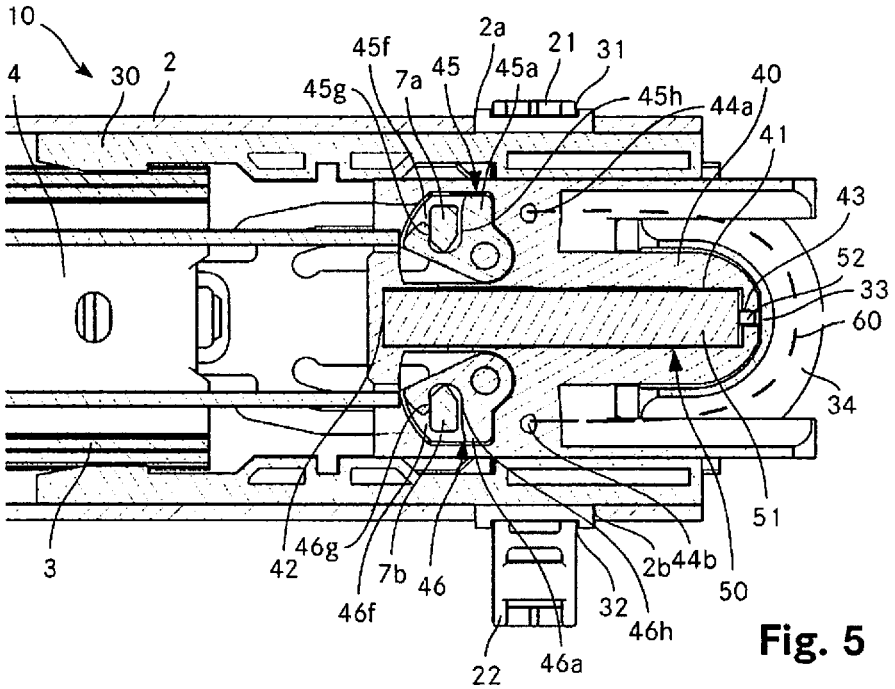
FIG. 5 shows a second cross section through the retraction device according to the invention, in the retracted position.

FIGS. 3 to 5 show the retraction device according to the invention in the retracted position. FIG. 3 shows a rear view, FIG. 4 shows a first cross section parallel to the main plane of the drawer mechanism, and FIG. 5 shows a second cross section parallel to said main plane. The first cross section according to FIG. 4 herein runs in the plane of the blocking latch bolts 21, 22.

The second cross section according to FIG. 5 runs in the plane of the pivot elements that interact with the holding cams 7*a*, 7*b* of the inner rail 4. The first cross section thus runs between the rear side shown in FIG. 3 and the second cross section.

The retraction device 10 comprises a housing 30 which forms a guide receptacle and which is received between the legs of the U-shaped outer rail 2 (cf. FIGS. 4, 5). The housing 30 is made from a polymer and by virtue of the elasticity thereof is held on the outer rail 2 by a clip-fit connection. The housing 30 has lateral openings 31, 32 which in the attached state of the housing 30 correspond to openings 2*a*, 2*b* in the two legs of the outer rail 2. The openings 31, 32 are configured in mouthparts of the housing 30 which furthermore fix the retraction device 10 axially in the outer rail 2.

The housing 30 likewise has a substantially U-shaped cross section. Longitudinal grooves are configured at the transition between the base and the two legs that project orthogonally from said base. Guide portions of a slide 40 are mounted so as to be movable in a linear manner in said longitudinal grooves. The slide 40 can thus be moved relative to the housing 30 in the retraction/extension direction.

The slide 40 comprises a receptacle 41 for a damping element 50 (cf. FIG. 5), said receptacle 41 running along the centerline of said slide 40. Said receptacle has a rectangular base area and an approximately square cross section such that the main body 51 of the cylindrical damping element 50 can be received. The receptacle 41 on the end thereof that faces the inner rail has a support face 42 on which the rear end of the main body 51 of the damping element 50 is supported. The receptacle 41 at the opposite end has a passage opening 43 through which a damper rod 52 of the damper element 50 can enter.

The damping element 50 is a fluid damper known per se, the damper rod 52 thereof by way of a spring being pretensioned to the extended position. The damper rod 52 in the assembled position contacts a detent 33 on the housing 30. Said detent 33 is configured on the internal side of an arcuate deflection element 34. A coil spring 60 (cf. FIG. 5; only indicated by a dashed line for the sake of better clarity) which by way of both ends is fastened to fastening pins 44*a*, 44*b* of the slide 40 runs about said deflection element 34, said coil spring 60 being mounted so as to slide on said deflection element 34. The slide 40 by way of the at all times pretensioned coil spring 60 is thus impinged by a force in the retraction direction.

Two pivot elements 45, 46 are mounted on a base plate of the slide 40 so as to be pivotable about axes that are oriented so as to be perpendicular to the main plane of the retraction device 10 and disposed so as to be symmetrical to the central longitudinal axis of the retraction device 10 (cf. FIGS. 4, 5). The axes in the retraction/extension direction herein are located in front of a central axis of the blocking latch bolts 21, 22, that is to say so as to be closer to the inner rail 4 than the blocking latch bolts 21, 22. The pivot elements 45, 46 comprise a front part 45*a*, 46*a* which is located ahead of the pivot axis and faces the inner rail 4, and a rear part 45*b*, 46*b* which is located behind the pivot axis and faces the corresponding blocking latch bolt 21, 22. The front part 45*a*, 46*a* is received in a breakout of the base plate of the slide 40, while the rear part 45*b*, 46*b* is located on the rear side of the base plate.

The rear part 45*b*, 46*b* of the pivot element 45, 46 in the plane illustrated in FIG. 4 has a receptacle 45*c*, 46*c* for the free end of the corresponding blocking latch bolt 21, 22. The geometry of the receptacle 45*c*, 46*c* is adapted to the geometry of the blocking latch bolt 21, 22; the receptacle 45*c*, 46*c* thus has a concave shape having a lug 45*d*, 46*d* which can engage behind an inserted blocking latch bolt 21, 22. The slide 40 in the same plane in which the rear part 45*b*, 46*b* of the pivot element 45, 46 can interact with the blocking latch bolt 21, 22 has a ramp-type interaction face 49*a*, 49*b*. Both the receptacle 45*c*, 46*c* in the region of the lug 45*d*, 46*d* as well as the interaction face 49*a*, 49*b* herein are at an angle of 45° in relation to the central longitudinal axis of the retraction device 10.

The pivot elements 45, 46 on the rear side, in the region of the front part 45*a*, 46*a*, have a guide pin 45*e*, 46*e*. Said guide pin 45*e*, 46*e* interacts with a guide curve 35, 36 which is configured in the housing 30 of the retraction device 10. The guide curve 35, 36, in a manner analogous to that of the pivot elements 45, 46 and of the guide pins 45*e*, 46*e*, is configured so as to be symmetrical in relation to the central longitudinal axis of the retraction device 10. Said guide curve 35, 36 has a rear portion 35*a*, 36*a* that runs so as to be substantially axial (thus in the retraction/extension direction), a portion 35*b*, 36*b* which adjoins said guide curve 35, 36 at the front (thus in the direction of the inner rail 4) and tapers obliquely toward the central longitudinal axis, as well as a portion 35*c*, 36*c* which again adjoins at the front and runs transversely to the central longitudinal axis. The inner lateral delimitation of the rear portion 35*a*, 36*a*, thus the lateral delimitation that is closer to the central longitudinal axis of the retraction device 10, is formed by a resilient tongue 35*d*, 36*d* on the internal side.

The blocking latch bolts 21, 22 have a substantially rectangular cross section. The width of the blocking latch bolts 21, 22 in the region of the free end is reduced in the plane that interacts with the pivot elements 45, 46 such that a symmetrical trapezoidal shape results in said region. The blocking latch bolts in a plane behind the pivot elements 45, 46 extend farther inward, said blocking latch bolts on the free end thereof having a step-type shaping such that forces acting along the blocking latch bolts and blocking bars can be transmitted from one side of the retraction device 10 to the other (cf. FIG. 3).

The pivot elements 45, 46 in a plane ahead of the main body of the slide 40 have a receptacle 45*f*, 46*f* (cf. FIG. 5). Said receptacle 45*f*, 46*f* is open toward the outside, that is to say in the direction away from the central longitudinal axis of the retraction device 10, and on the side facing the inner rail 4 is delimited by a holding portion 45*g*, 46*g*, and on the side facing away from the inner rail 4 is delimited by an activation portion 45*h*, 46*h*.

Figure 6:
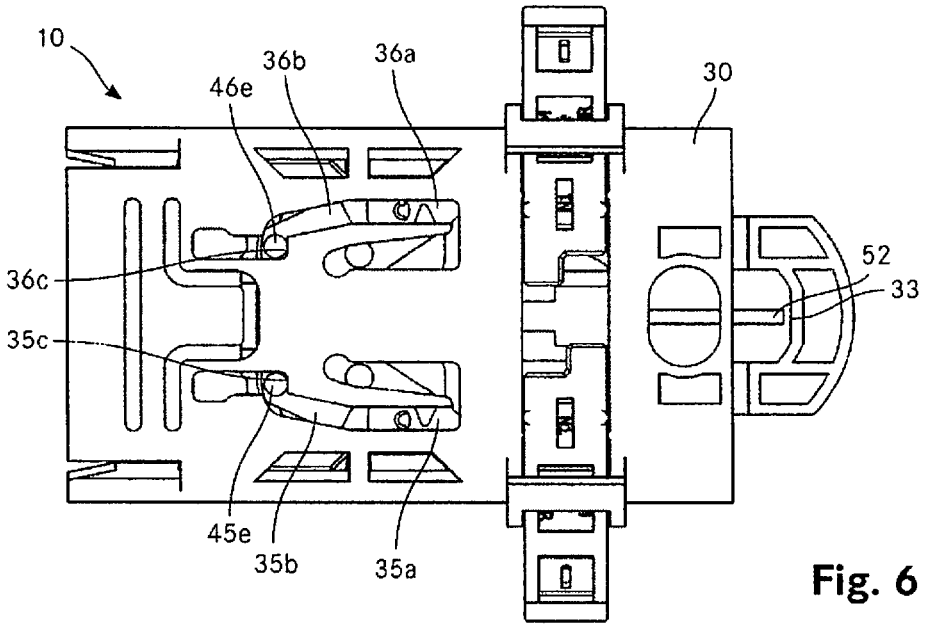
FIG. 6 shows a rear view of the retraction device according to the invention, in the standby position.
Figure 7:
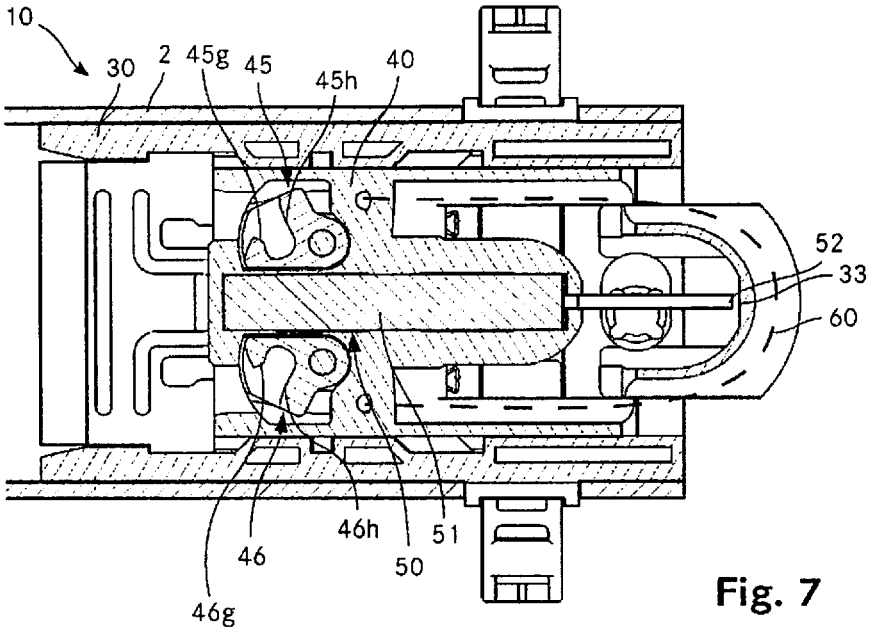
FIG. 7 shows a cross section through the retraction device according to the invention, in the standby position.

FIG. 6 shows a rear view of the retraction device according to the invention. Said FIG. 6 corresponds to the view according to FIG. 3, the device however is now located in the standby position. FIG. 7 shows a cross section through the retraction device according to the invention in the standby position. The illustration otherwise corresponds to that of FIG. 5. The functioning of the retraction device 10 will be explained hereunder by means of FIGS. 3 to 7.

The two pivot elements 45, 46 in the retracted position according to FIGS. 3 to 5, by virtue of the interaction between the guide pins 45*e*, 46*e* and the guide curve 35, 36, by way of the front part 45*a*, 46*a* of said pivot elements 45, 46 are outwardly pivoted, and the holding cams 7*a*, 7*b* of the inner rail 4 are received behind the holding portion 45*g*, 46*g* in the receptacle 45*f*, 46*f*. When the respective drawer is now extended, the extension movement is transmitted directly to the inner rail 4. The holding cams 7*a*, 7*b* fixedly disposed on said inner real 4 by way of the holding portions 45*g*, 46*g* entrain the pivot elements 45, 46 and thus the slide 40 along the guide formed by the housing 30. The guide pins 45*e*, 46*e* herein are guided in the guide curves 35, 36. The coil spring 60 when extracting is moreover (further) tensioned. The damper rod 52 of the damping element 50 by virtue of the spring integrated in the damping element 50 is extended until the free end of said damper rod 52 impacts in each case again on the detent 33. In the case of a rapid extraction of the drawer the damper rod 52 can intermittently lose contact with the detent 33. This is irrelevant in the context of the extraction movement. However, by virtue of the respective arrangement, it is avoided that potentially arising high forces could be transmitted to the damping element and damage the latter.

As soon as the guide pins 45*e*, 46*e* have left the rear portion 35*a*, 36*a* and are guided in the central portion 35*b*, 36*g*, a pivoting movement of the pivot elements 45, 46 results by virtue of the tapered geometry of said guide pins 45*e*, 46*e*. The holding portions 45*g*, 46*g* are steadily pivoted inward, toward the central longitudinal axis of the retraction device 10. A release of the holding cams 7*a*, 7*b* of the inner rail 4 is however performed only once the guide pins 45*e*, 46*e* are transferred into the portions 35*c*, 36*c* that run transversely to the central longitudinal axis. The inner rail is separated from the retraction device 10 by way of the release of the holding cams 7*a*, 7*b*. The guide pins 45*e*, 46*e* in the standby position thus reached are held on the rearward face of the transversely running portions 35*c*, 36*c*. The coil spring 60 thus remains tensioned, and the slide 40 remains in the position reached. The damper rod 52 of the damping element 50 is located in the elongated position, the free end of said damper rod 52 contacting the detent 33 on the housing 30 of the retraction device 10.

The standby position as established in FIGS. 6 and 7 is now maintained until the drawer is closed again and the holding cams 7*a*, 7*b* in this context come into contact again with the pivot elements 45, 46 of the slide 40. The holding cams 7*a*, 7*b* herein initially contact the activation portions 45*h*, 46*h* of the pivot elements 45, 46. In the case of a slide 40 that is initially held firmly in the axial direction, the pivot elements 45, 46 are then pivoted outward such that the guide pins 45*e*, 46*e* enter the central portion 35*b*, 36*b* of the guide curve 35, 36, and the holding portions 45*g*, 46*g* of the pivot element again engage axially behind the holding cams 7*a*, 7*b*. The central and the rear portion 35*b*, 35*a*, 36*b*, 36*a* of the guide curve permit a retraction movement of the slide 40 caused by the coil spring 60, in which retraction movement the inner rail and thus the entire drawer mechanism is entrained. This movement is damped by the damping element 50 which is disposed between the slide 40 and the housing 30. The movement ends when the slide 40 by way of the rear end thereof meets the housing in the region of stroke-termination faces 61*a*, 61 *b* (cf. FIG. 4). The pivot elements 45, 46, by virtue of the interaction between the guide curves 35, 36 and the guide pins 45*e*, 46*e*, are again moved back to the pivoted position of said pivot elements 45, 46 in the retracted position.

Should the retraction device 10 in the context of the assembly procedure or following an erroneous manipulation be located in the retracted position but the inner real not be coupled to the retraction device 10, the initial state according to FIGS. 3 to 5 can be established in a simple manner. To this end, the inner rail is moved toward the retraction device 10 (by inserting the drawer). The holding cams 7*a*, 7*b* herein come into contact with a front side of the holding portions 45*g*, 46*g*. The shaping of the latter is such that said holding portions 45*g*, 46*g* on account thereof are pushed inward and herein cause a corresponding pivoting movement of the pivot elements 45, 46 until the holding cams 7*a*, 7*b* have passed the holding portions 45*g*, 46*g*. The latter then snap back such that the holding cams 7*a*, 7*b* are received in the desired manner in the receptacles 45*f*, 46*f*. The corresponding pivoting movement of the pivot elements 45, 46 in the case of this procedure is enabled by the resilient tongues 35*d*, 36*d* which inwardly delimit the rear portions 35*a*, 36*a* of the guide curves 35, 36. The resilient tongues 35*d*, 35*d* moreover ensure that the holding portions 45*g*, 46*g* snap back after passing the holding cams 7*a*, 7*b*.

The blocking latch bolts 21, 22 in the retracted position according to FIGS. 3 to 5 can be moved into the retraction device 10. The front end of said locking latch bolts 21, 22 is then initially received in the receptacle 45*c*, 46*c* of the corresponding pivot element 45, 46. Each of the blocking latch bolts 21, 22 can in principle now be freely movable in a linear manner. This is the case when none of the drawers of a plurality of drawers lying on top of one another is open. In this case, the drawer assigned to the retraction device 10 can be readily opened. Blocking latch bolts which are initially moved into the retraction device, in particular blocking latch bolts 21 which are disposed above the retraction device 10 and by virtue of gravity are located in the moved-in position, herein by the corresponding interaction face 49*a*, 49*b* of the slide 40 are steadily moved out of the retraction device 10.

The coupling in the effective direction of the blocking latch bolts 21, 22 and the blocking bars by way of the step-type shaping thus leads to only one of a plurality of drawers disposed on top of one another being able to be opened at all times. The retraction devices of the further drawers are blocked by way of the blocking latch bolts and blocking bars such that the corresponding further draw mechanisms can no longer be extended.

When one of the blocking latch bolts 21, 22 by virtue of a further drawer that has already been opened is now located in a blocking position, said blocking latch bolt 21, 22 cannot be moved in the linear movement direction of the blocking latch bolt 21, 22. An extraction movement of the retraction device 10 and thus a release of the holding cams 7*a*, 7*b* is thus prevented by virtue of the interaction between the blocking latch bolt 21, 22 and the corresponding pivot element 45, 46. By virtue of the shaping of the pivot element 45, 46 by way of the lug 45*d*, 46*d* this is also ensured when the blocking blocking latch bolt 21, 22 by virtue of production tolerances or thermal effects does not reach completely up to the end of the receptacle. The tapered region of the blocking latch bolt 21, 22 also in this case, optionally after a minimal axial movement of the slide 40, will interact across a large area with the face that delimits the lug 45*d*, 46*d* and prevent any pivoting movement (which otherwise would in principle be possible by virtue of the resilient tongue of the guide curve).

The invention is not limited to the exemplary embodiment illustrated. Specifically the geometry of the individual elements of the retraction device can also be designed differently.

Summarizing, it is to be stated that the invention achieves a retraction device which is simply constructed and mechanically robust.

The invention claimed is:

1. Drawer mechanism having a fixed rail element for attaching to a furniture cabinet and at least one movable rail element mounted on said fixed rail element, comprising an inner rail being an innermost movable rail element to be fastened to an extendable furniture part, the drawer mechanism comprising a retraction device having a spring-loaded slide movable in the retraction/extension direction for temporarily coupling to a coupling element disposed in a region of a free end of the inner rail, wherein the slide is capable of being blocked in a retraction position by a blocking latch bolt that in a guide is movable transversely to the retraction/extension direction, wherein the slide for coupling to the coupling element of the inner rail has at least one pivot element which is pivotable about an axis that is oriented so as to be perpendicular to the retraction/extension direction and perpendicular to the movement direction of the blocking latch bolt, a geometry of the pivot element being adapted to a geometry of the coupling element, such that the pivot element interacts with the coupling element for temporary coupling the slide to the inner rail, wherein the pivot element and the guide are disposed in such a manner that the blocking latch bolt in a blocking position blocks a pivoting movement of the pivot element, the pivot element having a blocking portion which in the blocking position interacts with the blocking latch bolt and the blocking portion comprises a lug which in the blocking position engages behind a free end of the blocking latch bolt, such that the pivoting movement of the pivot element is avoided even when the blocking latch bolt is slightly displaced outward.

2. The drawer mechanism as claimed in claim 1, wherein the pivot element has a holding portion that in an extension movement interacts with the coupling element, wherein the pivot element is mounted on the slide in such a manner that the holding portion in a release position in relation to a holding position is pivoted in the direction of a longitudinal central axis of the slide.

3. The drawer mechanism as claimed in claim 1, wherein the pivot element has an eccentrically disposed cam pin which interact with a stationary curve for controlling the pivoting movement of the pivot element, when the slide is moved in the retraction/extension direction.

4. The drawer mechanism as claimed in claim 3, wherein the stationary curve in a portion has an elastic delimitation wall such that the inner rail in a retracted position of the retraction device is capable, by overcoming an insertion force, of being coupled to the slide in that a holding portion of the pivot element is temporarily pivoted, wherein the cam pin temporarily deforms the elastic delimitation wall.

5. The drawer mechanism as claimed in claim 1, comprising a guide receptacle in which the slide is mounted so as to be movable in a linear manner in the retraction/extension direction.

6. The drawer mechanism as claimed in claim 3, comprising a guide receptacle in which the slide is mounted so as to be movable in a linear manner in the retraction/extension direction, wherein the stationary curve is configured on the guide receptacle.

7. The drawer mechanism as claimed in claim 1, wherein the pivot element has an activation portion that in an retraction movement interacts with the coupling element.

8. The drawer mechanism as claimed in claim 1, wherein the slide has a blocking face which in the blocking position interacts with the blocking latch bolt.

9. The drawer mechanism as claimed in claim 8, wherein the blocking portion and the blocking face in the retracted state of the slide conjointly form a receptacle for the blocking latch bolt, said receptacle tapering in the direction of a longitudinal central axis of the slide.

10. The drawer mechanism as claimed in claim 2, wherein the holding portion of the pivot element is disposed on a first side of the slide that faces the inner rail, and in that the blocking portion of the pivot element is disposed on a second side of the slide that is opposite the first side.

11. The drawer mechanism as claimed in claim 1, wherein two pivot elements are disposed so as to be symmetrical to the longitudinal central axis of the slide.

12. The drawer mechanism as claimed in claim 1, comprising a damping element that is received in the slide.

13. The drawer mechanism as claimed in claim 12, wherein a damper rod of the damping element interacts with a stationary element of the retraction device.

14. The drawer mechanism as claimed in claim 13, wherein the stationary element is disposed in the retraction direction of the slide.

* * * * *